US012259165B2

(12) United States Patent
Prins et al.

(10) Patent No.: US 12,259,165 B2
(45) Date of Patent: Mar. 25, 2025

(54) METHOD FOR CONTROLLING SUCTION PRESSURE OF A VAPOUR COMPRESSION SYSTEM

(71) Applicant: Danfoss A/S, Nordborg (DK)

(72) Inventors: Jan Prins, Nordborg (DK); Lars Finn Sloth Larsen, Nordborg (DK)

(73) Assignee: DANFOSS A/S, Nordborg (DK)

( * ) Notice: Subject to any disclaimer, the term of this patent is extended or adjusted under 35 U.S.C. 154(b) by 679 days.

(21) Appl. No.: 17/609,876

(22) PCT Filed: Aug. 13, 2020

(86) PCT No.: PCT/EP2020/072723

§ 371 (c)(1),
(2) Date: Nov. 9, 2021

(87) PCT Pub. No.: WO2021/058193

PCT Pub. Date: Apr. 1, 2021

(65) Prior Publication Data

US 2022/0221207 A1 Jul. 14, 2022

(30) Foreign Application Priority Data

Sep. 26, 2019 (EP) ..... 19199832

(51) Int. Cl.
*F25B 49/02* (2006.01)
*F25B 1/10* (2006.01)
(Continued)

(52) U.S. Cl.
CPC ..... *F25B 49/02* (2013.01); *F25B 1/10* (2013.01); *F25B 5/02* (2013.01); *F25B 41/22* (2021.01);
(Continued)

(58) Field of Classification Search
CPC .... F25B 49/02; F25B 1/10; F25B 5/02; F25B 41/22; F25B 2341/0012; F25B 2400/23;
(Continued)

(56) References Cited

U.S. PATENT DOCUMENTS 3,670,519 A * 6/1972 Newton ..... F25B 41/00 62/191
10,378,796 B2 8/2019 Fredslund et al.
(Continued)

FOREIGN PATENT DOCUMENTS

CN 106537064 A 3/2017
CN 106931675 A 7/2017
(Continued)

OTHER PUBLICATIONS

International Search Report for PCT/EP2020/072723 Dated Nov. 2, 2020.

*Primary Examiner* — Eric S Ruppert
*Assistant Examiner* — Kirstin U Oswald
(74) *Attorney, Agent, or Firm* — McCormick, Paulding & Huber PLLC

(57) ABSTRACT

A method for controlling a vapour compression system (1) is disclosed. The vapour compression system (1) includes an ejector (4), and has a non-return valve (11) arranged in the refrigerant path between an outlet (12) of an evaporator (7) and an inlet (10) of a compressor unit (2), in such a manner that a refrigerant flow from the outlet (12) of the evaporator (7) towards the inlet (10) of the compressor unit (2) is allowed, while a fluid flow from the inlet (10) of the compressor unit (2) towards the outlet (12) of the evaporator (7) is prevented. A pressure, $P_0$, of refrigerant leaving the evaporator (7) is measured and a value being representative for a pressure, $P_{suc}$, of refrigerant entering the compressor unit (2) is obtained. The pressures, $P_0$ and $P_{suc}$, are compared to respective reference pressure values, $P_{0,ref}$ and $P_{suc,ref}$. In
(Continued)

the case that $\varepsilon_0 > \varepsilon_{suc}$, where $\varepsilon_0 = P_0 - P_{0,ref}$ and $\varepsilon_{suc} = P_{suc} - P_{suc,ref}$, the compressor unit (2) is controlled based on $P_0$, and in the case that $\varepsilon_{suc} > \varepsilon_0$, the compressor unit (2) is controlled based on $P_{suc}$.

20 Claims, 5 Drawing Sheets

(51) Int. Cl.
*F25B 5/02* (2006.01)
*F25B 41/22* (2021.01)

(52) U.S. Cl.
CPC ... *F25B 2341/0012* (2013.01); *F25B 2400/23* (2013.01); *F25B 2500/19* (2013.01); *F25B 2600/2509* (2013.01); *F25B 2700/1933* (2013.01); *F25B 2700/197* (2013.01)

(58) Field of Classification Search
CPC ..... F25B 2500/19; F25B 2600/2509; F25B 2700/1933; F25B 2700/197; F25B 41/00; F25B 9/08; F25B 31/00; F25B 39/02; F25B 41/20
USPC ..... 62/228.3
See application file for complete search history.

(56) References Cited

U.S. PATENT DOCUMENTS

| | | | | |
|---|---|---|---|---|
| 2004/0003608 | A1 | 1/2004 | Takeuchi et al. | |
| 2004/0123624 | A1* | 7/2004 | Ohta | F25B 41/00 62/500 |
| 2012/0167601 | A1* | 7/2012 | Cogswell | F25B 41/22 62/115 |
| 2015/0168024 | A1* | 6/2015 | Lee | F25B 41/00 62/511 |
| 2017/0321941 | A1* | 11/2017 | Fredslund | F25B 41/39 |
| 2018/0156499 | A1* | 6/2018 | Lifson | F25B 41/00 |
| 2018/0283750 | A1* | 10/2018 | Prins | F25B 49/02 |
| 2018/0283754 | A1* | 10/2018 | Prins | F25B 41/00 |
| 2018/0320944 | A1* | 11/2018 | Prins | F25B 9/08 |

FOREIGN PATENT DOCUMENTS

| | | | | |
|---|---|---|---|---|
| CN | 107003046 | A | 8/2017 | |
| EP | 3098543 | A1 | 7/2015 | |
| EP | 3 032 192 | A1 | 6/2016 | |
| EP | 3098544 | A1 * | 11/2016 | F25B 1/08 |
| EP | 3295096 | A1 | 3/2018 | |
| WO | 2016004988 | A1 | 1/2016 | |
| WO | 2016180481 | A1 | 11/2016 | |
| WO | 2016188777 | A1 | 12/2016 | |

* cited by examiner

METHOD FOR CONTROLLING SUCTION PRESSURE OF A VAPOUR COMPRESSION SYSTEM

CROSS-REFERENCE TO RELATED APPLICATION

This application is a National Stage application of International Patent Application No. PCT/EP2020/072723, filed on Aug. 13, 2020, which claims priority to European Application No. 19199832.7 filed on Sep. 26, 2019, each of which is hereby incorporated by reference in its entirety.

TECHNICAL FIELD

The present invention relates to a method for controlling a vapour compression system comprising an ejector. The method of the invention includes controlling a compressor unit of the vapour compression system in order to obtain an appropriate suction pressure.

BACKGROUND

In some vapour compression systems an ejector is arranged in a refrigerant path, at a position downstream relative to a heat rejecting heat exchanger. Thereby refrigerant leaving the heat rejecting heat exchanger is supplied to a primary inlet of the ejector. Refrigerant leaving an evaporator of the vapour compression system may be supplied to a secondary inlet of the ejector.

An ejector is a type of pump which uses the Venturi effect to increase the pressure energy of fluid at a secondary inlet (or suction inlet) of the ejector by means of a motive fluid supplied to a primary inlet (or motive inlet) of the ejector. Thereby, arranging an ejector in the refrigerant path as described above will cause the refrigerant to perform work, and thereby the power consumption of the vapour compression system is reduced as compared to the situation where no ejector is provided.

An outlet of the ejector is normally connected to a receiver, in which liquid refrigerant is separated from gaseous refrigerant. The liquid part of the refrigerant is supplied to the evaporator, via an expansion device. The gaseous part of the refrigerant may be supplied to a compressor, e.g. via a bypass valve. Thereby the gaseous part of the refrigerant is not subjected to the pressure drop introduced by the expansion device, and the work required in order to compress the refrigerant can thereby be reduced.

When the ambient temperature is high, such as during the summer period, the temperature as well as the pressure of the refrigerant leaving the heat rejecting heat exchanger is relatively high. In this case the ejector performs well, and it is advantageous to supply all of the refrigerant leaving the evaporator to the secondary inlet of the ejector, and to supply gaseous refrigerant to the compressors from the receiver only. When the vapour compression system is operated in this manner, it is sometimes referred to as 'summer mode'.

On the other hand, when the ambient temperature is low, such as during the winter period, the temperature as well as the pressure of the refrigerant leaving the heat rejecting heat exchanger is relatively low. In this case the ejector is not performing well, and it is advantageous to supply the refrigerant leaving the evaporator to the compressors, instead of to the secondary inlet of the ejector. When the vapour compression system is operated in this manner, it is sometimes referred to as 'winter mode'.

When the ambient temperature changes from a temperature regime which may be regarded as corresponding to 'summer mode' operating conditions to a temperature regime which may be regarded as corresponding to 'winter mode' operating conditions, or vice versa, it is desirable to be able to ensure that the vapour compression system is also switched from operating in the 'summer mode' to operating in the 'winter mode', or vice versa.

WO 2016/188777 A1 discloses a vapour compression system comprising an ejector, and further comprising a non-return valve arranged in the refrigerant path between an outlet of the evaporator and an inlet of the compressor unit, in such a manner that a refrigerant flow from the outlet of the evaporator towards the inlet of the compressor unit is allowed, while a fluid flow from the inlet of the compressor unit towards the outlet of the evaporator is prevented. The non-return valve ensures that the vapour compression system is automatically switched between operating in 'summer mode' and operating in 'winter mode', due to pressure changes in the vapour compression system caused by changing ambient temperatures.

It is often desirable to control the compressor unit of a vapour compression system based on the pressure of refrigerant leaving the evaporator, because this ensures an appropriate performance of the evaporator. However, when the vapour compression system is provided with a non-return valve, as it is the case in the vapour compression system disclosed in WO 2016/188777 A1, there may be a risk that the pressure in the part of the refrigerant path which interconnects the receiver and the compressor unit reaches an unacceptable level. It is desirable to avoid this.

SUMMARY

It is an object of embodiments of the invention to provide a method for controlling a vapour compression system with an ejector, in a manner which ensures that the evaporator operates in an appropriate manner while it is efficiently prevented that excessive pressure levels occur in the vapour compression system.

The invention provides a method for controlling a vapour compression system, the vapour compression system comprising a compressor unit comprising one or more compressors, a heat rejecting heat exchanger, an ejector, a receiver, at least one expansion device and at least one evaporator arranged in a refrigerant path, an outlet of the heat rejecting heat exchanger being connected to a primary inlet of the ejector, an outlet of the ejector being connected to an inlet of the receiver, and an outlet of the evaporator being connected to a secondary inlet of the ejector and to an inlet of the compressor unit, wherein the vapour compression system further comprises a non-return valve arranged in the refrigerant path between the outlet of the evaporator and the inlet of the compressor unit, in such a manner that a refrigerant flow from the outlet of the evaporator towards the inlet of the compressor unit is allowed, while a fluid flow from the inlet of the compressor unit towards the outlet of the evaporator is prevented, and wherein a gaseous outlet of the receiver is connected to the inlet of the compressor unit via a bypass valve, the method comprising the steps of:

- measuring a pressure, $P_0$, of refrigerant leaving the evaporator,
- obtaining a value being representative for a pressure, $P_{suc}$, of refrigerant entering the compressor unit,
- comparing the pressures, $P_0$ and $P_{suc}$, to respective reference pressure values, $P_{0,ref}$ and $P_{suc,ref}$, in the case that $\varepsilon_0>\varepsilon_{suc}$, where $\varepsilon_0=P_0-P_{0,ref}$ and $\varepsilon_{suc}=P_{suc}-P_{suc,ref}$, controlling the compressor unit based on $P_0$, and in the case that $\varepsilon_{suc}>\varepsilon_0$, controlling the compressor unit based on $P_{suc}$.

Thus, the method according to the invention is a method for controlling a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

The vapour compression system comprises a compressor unit comprising one or more compressors, a heat rejecting heat exchanger, an ejector, a receiver, at least one expansion device and at least one evaporator arranged in a refrigerant path. An outlet of the heat rejecting heat exchanger is connected to a primary inlet of the ejector and an outlet of the ejector is connected to an inlet of the receiver. A non-return valve is arranged in the refrigerant path between an outlet of the evaporator and an inlet of the compressor unit. Accordingly, the outlet of the evaporator is connected to the inlet of the compressor unit, via the non-return valve, and to a secondary inlet of the ejector. Thus, refrigerant leaving the evaporator may either be supplied to the secondary inlet of the ejector or to the inlet of the compressor unit.

Accordingly, refrigerant flowing in the refrigerant path is compressed by means of the compressors in the compressor unit, and the compressed refrigerant is supplied to the heat rejecting heat exchanger. In the heat rejecting heat exchanger heat exchange takes place between the refrigerant flowing through the heat rejecting heat exchanger and the ambient, in such a manner that heat is rejected from the refrigerant to the ambient. In the case that the heat rejecting heat exchanger is in the form of a condenser, the refrigerant is at least partly condensed, and in the case that the heat rejecting heat exchanger is in the form of a gas cooler, the refrigerant is cooled, but remains in the gaseous phase.

The refrigerant leaving the heat rejecting heat exchanger is supplied to a primary inlet of the ejector, where the refrigerant undergoes expansion before being supplied to the receiver.

In the receiver the refrigerant is separated into a liquid part and a gaseous part. The liquid part of the refrigerant is supplied to the expansion device, via a liquid outlet. The expansion device expands the refrigerant before it is supplied to the evaporator. The refrigerant being supplied to the evaporator is in a mixed liquid and gaseous state. In the evaporator, the liquid part of the refrigerant is at least partly evaporated, while heat exchange takes place between the refrigerant and the ambient in such a manner that heat is absorbed by the refrigerant flowing through the evaporator.

The gaseous part of the refrigerant in the receiver may be supplied to the inlet of the compressor unit, via a gaseous outlet of the receiver and a bypass valve. Thus, when the bypass valve is closed, gaseous refrigerant is not supplied directly from the receiver to the inlet of the compressor unit, and all refrigerant leaving the receiver is thereby supplied to the expansion device, via the liquid outlet. On the other hand, when the bypass valve is open, at least part of the gaseous refrigerant in the receiver is supplied directly to the inlet of the compressor unit. This refrigerant supply may be controlled by controlling an opening degree of the bypass valve. The bypass valve may be connected to a part of the refrigerant path which interconnects the non-return valve and the inlet of the compressor unit.

The refrigerant leaving the evaporator is supplied to the inlet of the compressor unit, via the non-return valve, and/or to the secondary inlet of the ejector. As described above, when the ambient temperature is high, such as during the summer period, all or most of the refrigerant leaving the evaporator is supplied to the secondary inlet of the ejector, and when the ambient temperature is low, such as during the winter period, all or most of the refrigerant leaving the evaporator is supplied to the inlet of the compressor unit. The non-return valve arranged in the refrigerant path between the outlet of the evaporator and the inlet of the compressor unit ensures that a switch between these two operating regimes is performed when the temperature changes.

The non-return valve is arranged to allow refrigerant flow from the outlet of the evaporator towards the inlet of the compressor unit, but to prevent refrigerant flow from the inlet of the compressor unit towards the outlet of the evaporator. Accordingly, refrigerant leaving the evaporator is allowed to reach the inlet of the compressor unit, via the non-return valve. However, a reverse flow of refrigerant from the inlet of the compressor unit, towards the outlet of the evaporator is prevented by the non-return valve.

The non-return valve could, e.g., be of a passive kind or of an actively controlled kind. A passive valve could, e.g., be a simple check valve, or of a type comprising a resilient valve member pressed against another valve member in the closed position. Alternatively or additionally, the passive valve could be of a spring biased type. An actively controlled valve could, e.g., rely on mechanical valve switching or it could rely on electromagnetic switching.

According to the method of the invention, a pressure, $P_0$, of refrigerant leaving the evaporator is measured. This could, e.g., be obtained by means of an appropriate pressure sensor arranged in the refrigerant path immediately downstream with respect to the outlet of the evaporator.

Furthermore, a value being representative for a pressure, $P_{suc}$, of refrigerant entering the compressor unit is obtained. This could, e.g., include a direct measurement of this pressure. Alternatively, one or more other parameters related to the vapour compression system may be measured, and the value being representative for the pressure, $P_{suc}$, may be derived therefrom. This will be described in further detail below. In any event, the value obtained in this manner provides a measure for the pressure prevailing in the part of the refrigerant path arranged immediately upstream relative to the inlet of the compressor unit.

When the non-return valve is open, thereby allowing refrigerant leaving the evaporator to reach the inlet of the compressor unit, $P_{suc}$ will be equal to or very close to $P_0$. On the other hand, when the non-return valve is closed, $P_{suc}$ will be larger than $P_0$.

Next, the pressures, $P_0$ and $P_{suc}$, are compared to respective reference pressure values, $P_{0,ref}$ and $P_{suc,ref}$. $P_{0,ref}$ represents a pressure level which it is desirable to maintain at the outlet of the evaporator, in order to ensure appropriate performance of the evaporator. $P_{suc,ref}$ represents a pressure level which it is desirable to maintain at the inlet of the compressor unit, in order to ensure appropriate operation of the compressor unit, and in order to prevent excessive pressure levels in this part of the refrigerant path.

Furthermore, error values, $P_0$ and $P_{suc}$, are compared. $\varepsilon_0=P_0-P_{0,ref}$, and thereby represents how much the measured pressure, $P_0$, differs from the desired pressure level, $P_{0,ref}$. Similarly, $\varepsilon_{suc}=P_{suc}-P_{suc,ref}$, and thereby represents how much the measured or derived pressure, $P_{suc}$, differs from the desired pressure level, $P_{suc,ref}$.

In the case that it turns out that $\varepsilon_0>\varepsilon_{suc}$, the pressure, $P_{suc}$, prevailing at the inlet of the compressor unit is closer to the corresponding desired pressure level, $P_{suc,ref}$, than is the case for the pressure, $P_0$, prevailing at the outlet of the evaporator and the corresponding desired pressure level, $P_{0,ref}$. It can therefore be assumed that the pressure level in the part of the refrigerant path connected to the inlet of the compressor unit is appropriate. Therefore, when this situation occurs, the compressor unit is controlled based on $P_0$. Thereby the compressor unit is controlled in such a manner that an appropriate refrigerant supply is provided to the evaporator, ensuring appropriate performance of the evaporator.

On the other hand, in the case that it turns out that $\varepsilon_{suc}>\varepsilon_0$, the pressure, $P_{suc}$, prevailing at the inlet of the compressor unit is further away from the corresponding desired pressure level, $P_{suc,ref}$, than is the case for the pressure, $P_0$, prevailing at the outlet of the evaporator and the corresponding desired pressure level, $P_{0,ref}$. It can therefore be assumed that the pressure of the refrigerant leaving the evaporator is at an acceptable level. However, there may be a risk that the pressure prevailing in the part of the refrigerant path connected to the inlet of the compressor unit may reach an unacceptable level. Therefore, when this situation occurs, the compressor unit is controlled based on $P_{suc}$. Thereby the compressor unit is controlled in such a manner that the pressure prevailing in the part of the refrigerant path which is connected to the inlet of the compressor unit is prevented from reaching an unacceptable level.

Thus, the compressor unit is controlled based on $P_0$ or based on $P_{suc}$, depending on the current operating conditions. Furthermore, it is ensured that, whenever possible, the compressor unit is operated in a manner which ensures appropriate performance of the evaporator. However, it is still ensured that the pressure prevailing in the part of the refrigerant path which is connected to the inlet of the compressor unit is not allowed to reach an unacceptable level. For instance, in a situation where the non-return valve is closed and the bypass valve is fully open, $P_{suc}$ may increase while $P_0$ remains steady, and in this case it may be desirable to adjust the operation of the compressor unit in order to decrease $P_{suc}$ to an acceptable level.

It should be noted that the comparison of the error values, $\varepsilon_0$ and $\varepsilon_{suc}$, may be performed without actually deriving the error values, as long as it can be determined which of the error values is larger than the other one. For instance, the ratio between the error values may be used. As an alternative, an error value, c, may be derived as $\varepsilon=P_{contr}-P_{0,ref}$, where $P_{contr}=\max(P_0, P_{suc}-\Delta P_{max})$, and $\Delta P_{max}=P_{suc,ref}-P_{0,ref}$, and the compressor unit may be controlled in order to minimise $\varepsilon$. As another alternative, a non-linear relationship between the error values may be used for the comparison.

$P_{suc,ref}$ may be selected in such a manner that $P_{suc,ref}=P_{0,ref}+\Delta P_{max}$, where $\Delta P_{max}$ is a maximum attainable pressure lift provided by the ejector.

When operating, an ejector sucks refrigerant from the outlet of the evaporator into the secondary inlet of the ejector, and the refrigerant is then supplied to the receiver. Thereby the pressure of the refrigerant is increased, i.e. a pressure lift is provided by the ejector. However, there is an upper limit on how large a pressure increase a given ejector can provide. This may be referred to as a maximum attainable pressure lift. When the bypass valve is fully open, and there is no further supply of refrigerant to the part of the refrigerant path which interconnects the non-return valve and the inlet of the compressor unit, $P_{suc}$ will be equal to, or almost equal to, the pressure prevailing inside the receiver. Furthermore, the pressure difference between the pressure prevailing at the outlet of the evaporator, i.e. $P_0$, and the pressure prevailing inside the receiver is exactly the pressure lift provided by the ejector under the given operating conditions. It is therefore appropriate to select a reference pressure, $P_{suc,ref}$, for the pressure, $P_{suc}$, at the inlet of the compressor unit, which exceeds the reference pressure, $P_{0,ref}$, for the pressure, $P_0$, at the outlet of the evaporator by an amount corresponding to the maximum attainable pressure lift provided by the ejector, i.e. $\Delta P_{max}$.

The vapour compression system may comprise at least one medium temperature evaporator and at least one low temperature evaporator, and the pressure, $P_0$, may be measured at an outlet of the medium temperature evaporator.

According to this embodiment, the vapour compression system is of a kind which comprises at least two groups of evaporators, i.e. a group comprising at least one medium temperature evaporator and a group comprising at least one low temperature evaporator. The vapour compression system could, e.g., be of a kind which is normally used in a supermarket, where some display cases are used for storing goods which are to be cooled, e.g. at a temperature of approximately 5° C., while other display cases are used for storing goods which are to be freezed, e.g. at a temperature of approximately −18° C. In this case the medium temperature evaporators will be applied in the cooling display cases, and the low temperature evaporators will be applied in the freezing display cases.

According to this embodiment, the pressure, $P_0$, is measured at the outlet of the medium temperature evaporator, rather than at the outlet of the low temperature evaporator. Accordingly, when the compressor unit is controlled in accordance with $P_0$, it is controlled in such a manner that an appropriate performance of the medium temperature evaporator is obtained.

The vapour compression system may further comprise a low temperature compressor unit, and an outlet of the low temperature evaporator may be connected to an inlet of the low temperature compressor unit, and an outlet of the low temperature compressor unit may be connected to the inlet of the compressor unit.

According to this embodiment, the vapour compression system comprises an additional compressor unit, i.e. the low temperature compressor unit, and the compressor unit described above may be referred to as a medium temperature compressor unit. Since the low temperature evaporator is operated at a lower temperature than the medium temperature evaporator, the pressure of the refrigerant leaving the low temperature evaporator is also expected to be lower than the pressure of refrigerant leaving the medium temperature evaporator. It may not be possible for the compressors of the compressor unit to increase the pressure to a level which is required for the refrigerant being supplied to the heat rejecting heat exchanger. Therefore the refrigerant leaving the low temperature evaporator is initially supplied to the low temperature compressor unit, in order to increase the pressure of the refrigerant to a level which is comparable to the pressure of the refrigerant leaving the medium temperature evaporator, before it is supplied to the compressor unit.

The outlet of the low temperature compressor unit may be connected to a part of the refrigerant path which interconnects the outlet of the medium temperature evaporator and the non-return valve. In this case the refrigerant supply from the low temperature compressor unit affects the pressure, $P_0$, possibly to the extent that the non-return valve opens and allows a refrigerant flow towards the inlet of the compressor unit.

As an alternative, the outlet of the low temperature compressor unit may be connected to a part of the refrigerant path which interconnects the non-return valve and the inlet of the compressor unit. In this case the refrigerant supply from the low temperature compressor unit affects the pressure, $P_{suc}$, but not the pressure, $P_0$. This introduces an increased risk that the pressure, $P_{suc}$, prevailing at the inlet of the compressor unit increases to an unacceptable level if the compressor unit is controlled solely based on $P_0$. Therefore the method according to the invention is particularly relevant in this case.

The method may further comprise the step of controlling a pressure prevailing inside the receiver by adjusting an opening degree of the bypass valve. It is often desirable to maintain a suitable pressure inside the receiver. For instance, the pressures prevailing inside the receiver should be within a range which ensures appropriate operation of the ejector, while ensuring a sufficient pressure drop across the expansion device. In order to obtain this, the bypass valve can be operated. For instance, if the pressure prevailing inside the receiver is too high, the bypass valve can be opened, or the opening degree of the bypass valve can be increased, thereby allowing an increased flow of gaseous refrigerant from the receiver to the inlet of the compressor unit. Similarly, if the pressure prevailing inside the receiver is too low, the bypass valve can be closed, or the opening degree of the bypass valve can be reduced.

The step of obtaining a value being representative for the pressure, $P_{suc}$, may comprise measuring $P_{suc}$. According to this embodiment, the value being representative for the pressure, $P_{suc}$, is in fact $P_{suc}$. Moreover, the value is obtained by direct measurement, using a suitable sensor, which may be arranged in the refrigerant path immediately upstream relative to the inlet of the compressor unit. This is an easy and precise manner of obtaining a value being representative for the pressure, $P_{suc}$.

As an alternative, the step of obtaining a value being representative for the pressure, $P_{suc}$, may comprise measuring a pressure prevailing inside the receiver and deriving $P_{suc}$ from the pressure prevailing inside the receiver. In the case that the bypass valve is open, the pressure, $P_{suc}$, at the inlet of the compressor unit is dependent on the pressure prevailing inside the receiver. It may be expected that the pressure difference corresponds to a pressure drop introduced by the bypass valve. This pressure drop depends on the opening degree of the bypass valve. For instance, if the bypass valve is fully open, the pressures will be substantially identical, whereas a larger pressure drop must be expected when the bypass valve is partly open. In any event, the pressure drop may be calculated, based on the opening degree and the characteristics of the bypass valve, thereby allowing the pressure, $P_{suc}$, to be derived from a measured value of the pressure prevailing inside the receiver. Thereby a separate pressure sensor for measuring $P_{suc}$ is not required.

As another alternative, the step of obtaining a value being representative for the pressure, $P_{suc}$, may comprise deriving $P_{suc}$ from $P_0$. In the case that the non-return valve is open, the pressure, $P_{suc}$, at the inlet of the compressor unit is dependent on the pressure, $P_0$, at the outlet of the evaporator. More particularly, the pressure difference between $P_0$ and $P_{suc}$ may be expected to correspond to a pressure drop introduced by the non-return valve. Accordingly, $P_{suc}$ can be derived from the measured $P_0$, based on the characteristics of the non-return valve.

The step of controlling the compressor unit based on $P_0$ may comprise controlling the compressor unit in order to obtain that $P_0=P_{0,ref}$, and/or the step of controlling the compressor unit based on $P_{suc}$ may comprise controlling the compressor unit in order to obtain that $P_{suc}=P_{suc,ref}$.

According to this embodiment, once it is determined whether $P_0$ or $P_{suc}$ should be used as control parameter, the compressor unit is controlled in such a manner that the selected control parameter reaches its corresponding reference pressure value. In other words, it is attempted to eliminate the corresponding error value, $\varepsilon_0$ or $\varepsilon_{suc}$, respectively.

BRIEF DESCRIPTION OF THE DRAWINGS

The invention will now be described in further detail with reference to the accompanying drawings in which.

DETAILED DESCRIPTION

Figure 1:
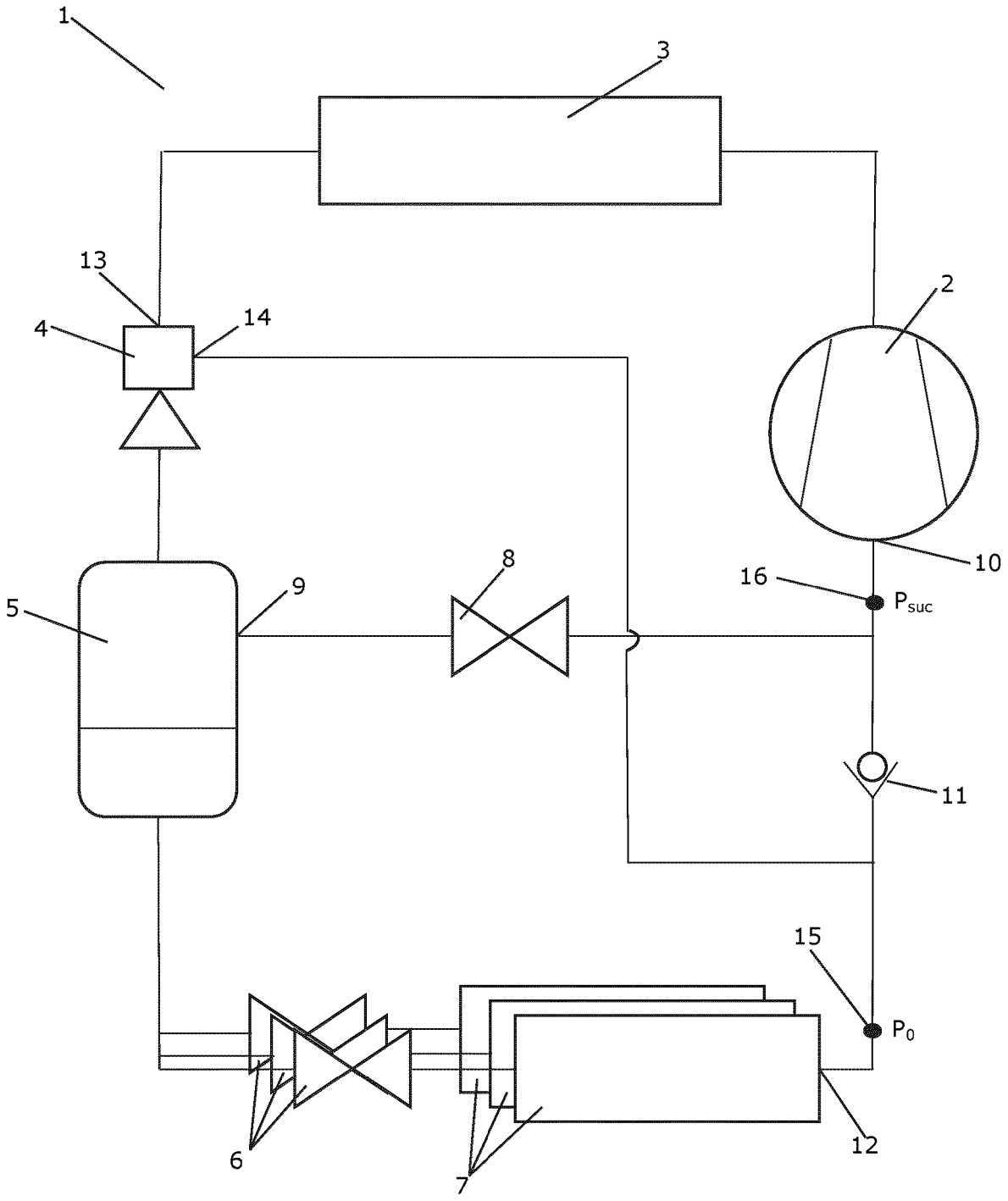
FIG. 1 is a diagrammatic view of a vapour compression system being operated according to a method according to a first embodiment of the invention.

FIG. 1 is a diagrammatic view of a vapour compression system 1 being operated in accordance with a method according to a first embodiment of the invention. The vapour compression system 1 comprises a compressor unit 2, a heat rejecting heat exchanger 3, an ejector 4, a receiver 5, three expansion devices 6 and three evaporators 7 arranged in a refrigerant path. The evaporators 7 are arranged fluidly in parallel, and each of the expansion devices 6 supplies refrigerant to one of the evaporators 7. A bypass valve 8 interconnects a gaseous outlet 9 of the receiver 5 and an inlet 10 of the compressor unit 2. A non-return valve 11 is arranged in the refrigerant path between an outlet 12 of the evaporators 7 and the inlet 10 of the compressor unit 2.

Refrigerant flowing in the refrigerant path is compressed by the compressor unit 2. The compressed refrigerant is supplied to the heat rejecting heat exchanger 3, where heat exchange takes place with the ambient in such a manner that heat is rejected from the refrigerant. The refrigerant leaving the heat rejecting heat exchanger 3 is supplied to a primary inlet 13 of the ejector 4. In the ejector 4, the refrigerant undergoes expansion, and is supplied to the receiver 5. In the receiver 5, the liquid part of the refrigerant is separated from the gaseous part of the refrigerant.

The liquid part of the refrigerant in the receiver 5 is supplied to the expansion devices 6, where it undergoes expansion before being supplied to the respective evaporators 7. In the evaporators 7, heat exchange takes place between the refrigerant and the ambient in such a manner that heat is absorbed by the refrigerant, while the liquid part of the refrigerant is at least partly evaporated.

The refrigerant leaving the evaporators 7 may either be supplied to the inlet 10 of the compressor unit 2, via the non-return valve 11, or it may be supplied to a secondary inlet 14 of the ejector 4.

When performing the method according to the invention, a pressure, $P_0$, of refrigerant leaving the evaporators 7 is measured by means of sensor 15, and a pressure, $P_{suc}$, of refrigerant entering the compressor unit 2 is measured by means of sensor 16. As an alternative, $P_{suc}$ could be obtained in an alternative manner, e.g. by deriving $P_{suc}$ from one or more other measured parameters, e.g. $P_0$ or a pressure prevailing inside the receiver 5.

$P_0$ and $P_{suc}$ are then compared to respective reference pressure values, $P_{0,ref}$ and $P_{suc,ref}$, and it is investigated whether $\varepsilon_0>\varepsilon_{suc}$ or $\varepsilon_{suc}>\varepsilon_0$, where $\varepsilon=P_0-P_{0,ref}$ and $\varepsilon=P_{suc}P_{suc,ref}$, $\varepsilon_0$ and $\varepsilon_{suc}$ may be referred to as error values.

If it turns out that $\varepsilon_0>\varepsilon_{suc}$, then $P_{suc}$ is closer to $P_{suc,ref}$ than $P_0$ is to $P_{0,ref}$. This indicates that the pressure prevailing in the part of the refrigerant path between the non-return valve 11 and the inlet 10 of the compressor unit 2, i.e. $P_{suc}$, is under control. On the other hand, it is very desirable to ensure that $P_0$ is very close to $P_{0,ref}$, because thereby it is ensured that the performance of the evaporators 7 is optimised. Therefore, when $\varepsilon_0>\varepsilon_{suc}$ the compressor unit 2 is controlled based on $P_0$. More particularly, the capacity of the compressor unit 2 is adjusted in order ensure a refrigerant supply to the evaporators 7 which results in $P_0$ being as close to $P_{0,ref}$ as possible, i.e. minimising go.

If it turns out that $\varepsilon_{suc}>\varepsilon_0$, then $P_0$ is closer to $P_{0,ref}$ than $P_{suc}$ is to $P_{suc,ref}$. This indicates that the pressure prevailing in the part of the refrigerant path between the non-return valve 11 and the inlet 10 of the compressor unit 2, i.e. $P_{suc}$, might be increasing towards an undesirable level. For instance, if the non-return valve 11 is closed, and all of the refrigerant which leaves the evaporators 7 is therefore supplied to the secondary inlet 14 of the ejector 4, this may lead to a situation where $P_{suc}$ increases while $P_0$ remains steady. This is particularly the case if the bypass valve 8 is also fully open. If the compressor unit 2 is controlled based on $P_0$ under these circumstances, there is a risk that $P_{suc}$ reaches an unacceptable level. Therefore, when this occurs, the compressor unit 2 is controlled based on $P_{suc}$.

Figure 2:
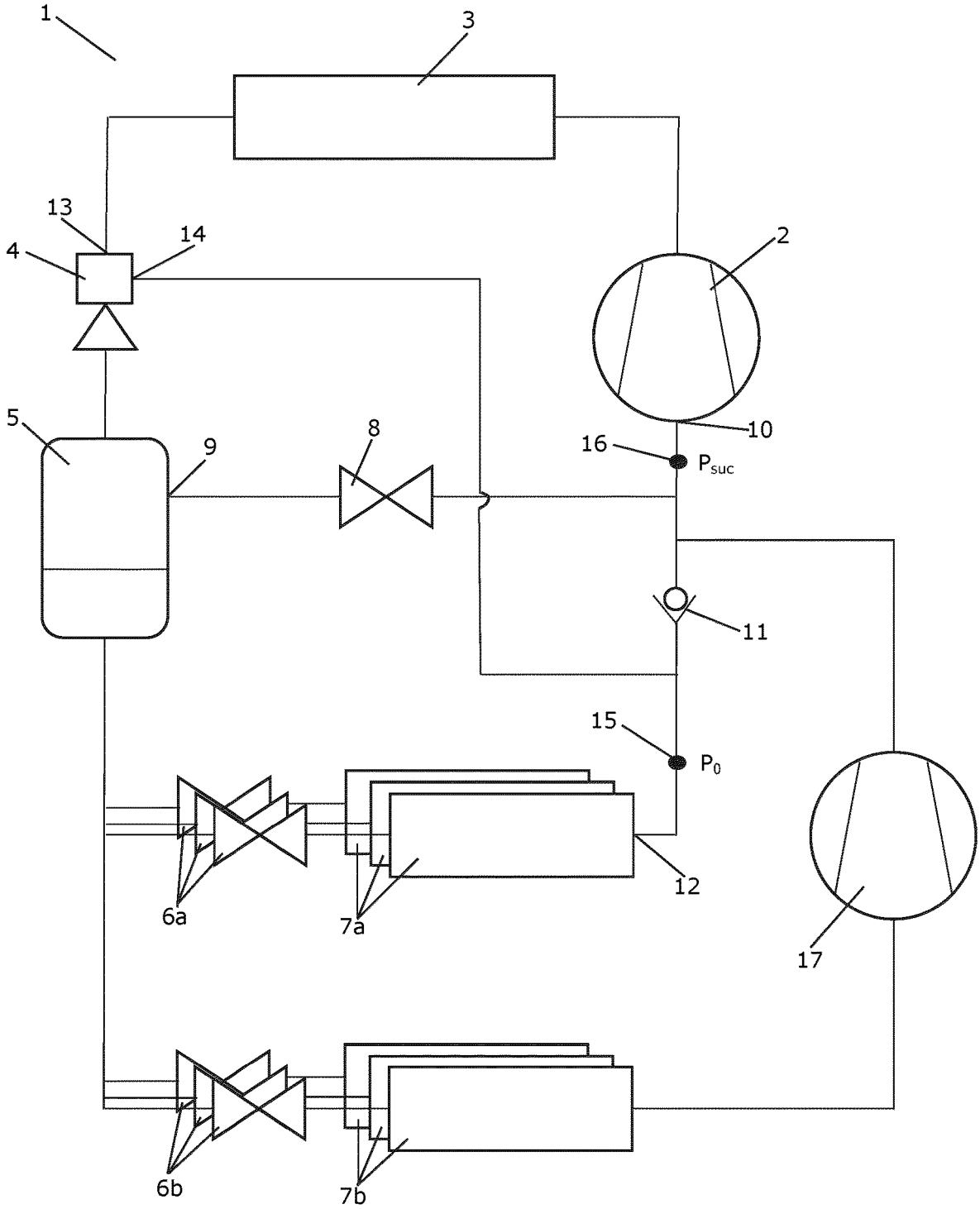
FIG. 2 is a diagrammatic view of a vapour compression system being operated according to a method according to a second embodiment of the invention.

FIG. 2 is a diagrammatic view of a vapour compression system 1 being operated in accordance with a method according to a second embodiment of the invention. The vapour compression system 1 is very similar to the vapour compression system 1 of FIG. 1, and it will therefore not be described in detail here.

The vapour compression system 1 of FIG. 2 comprises three medium temperature evaporators 7*a*, corresponding to the evaporators 7 illustrated in FIG. 1, and three low temperature evaporators 7*b*, each receiving refrigerant from a separate expansion device 6*b*. The low temperature evaporators 7*b* are designed to provide a lower cooling temperature than the medium temperature evaporators 7*a*. As a consequence, the pressure prevailing in the low temperature evaporators 7*b* is also lower than the pressure prevailing in the medium temperature evaporators 7*a*. Therefore the refrigerant leaving the low temperature evaporators 7*b* is supplied to a low temperature compressor unit 17, in order to increase the pressure of the refrigerant before it reaches the compressor unit 2.

The refrigerant leaving the low temperature compressor unit 17 is supplied to the refrigerant path between the non-return valve 11 and the inlet 10 of the compressor unit 2. Thereby this part of the refrigerant path receives a refrigerant supply which is completely independent of the refrigerant flow out of the medium temperature evaporators 7*a*, and thereby completely decoupled from $P_0$. Therefore, in this embodiment there is a particular risk that $P_{suc}$ increases while $P_0$ remains steady, and the method described above with reference to FIG. 1 is therefore particularly relevant here.

Figure 3:
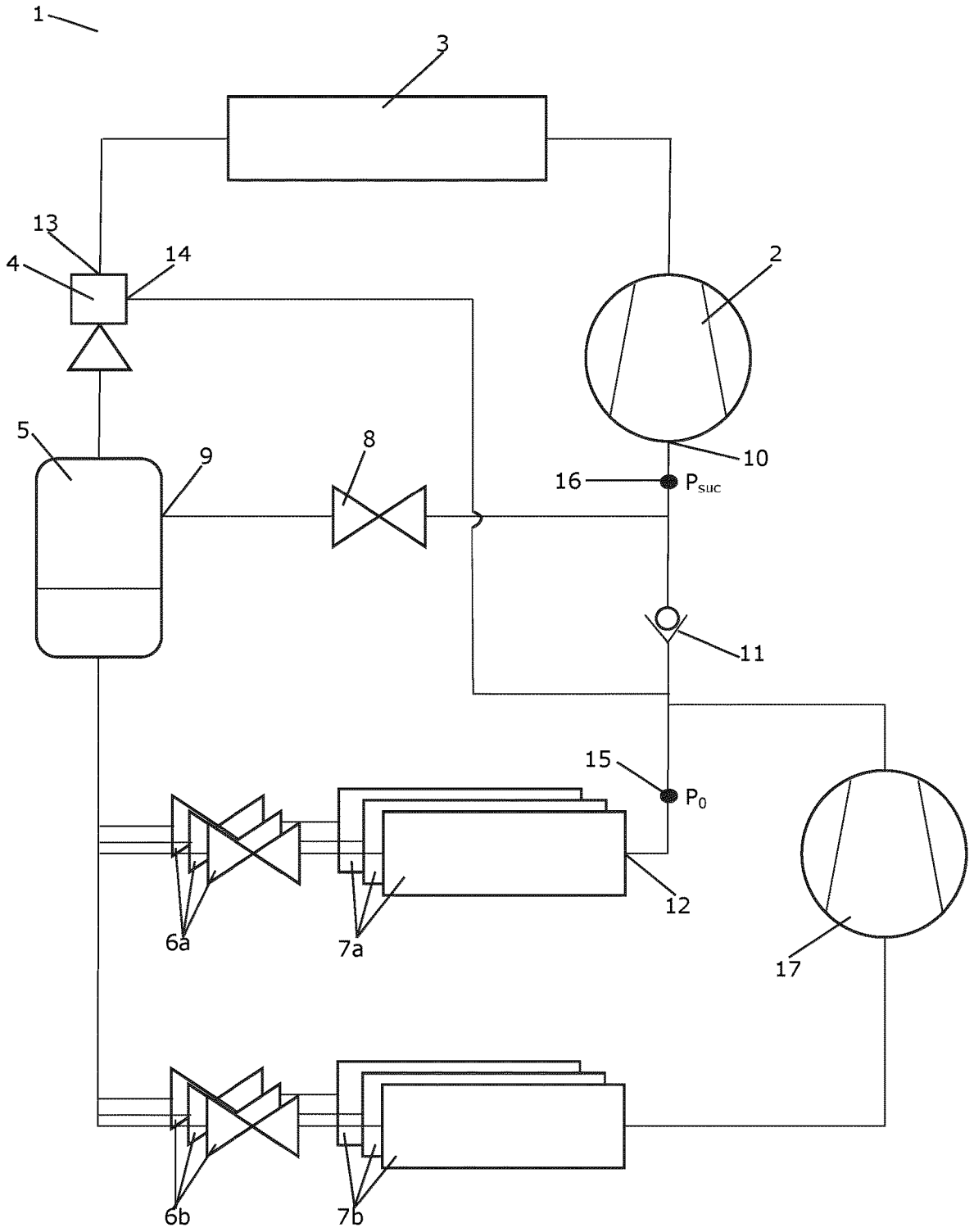
FIG. 3 is a diagrammatic view of a vapour compression system being operated according to a method according to a third embodiment of the invention.

FIG. 3 is a diagrammatic view of a vapour compression system 1 being operated in accordance with a method according to a third embodiment of the invention. The vapour compression system 1 is very similar to the vapour compression system 1 of FIG. 2, and it will therefore not be described in detail here.

In the vapour compression system 1 of FIG. 3 the refrigerant leaving the low temperature compressor unit 17 is supplied to the refrigerant path between the outlet 12 of the medium temperature evaporators 7*b* and the non-return valve 11. Thereby this supply of refrigerant directly affects $P_0$, but only indirectly affects $P_{suc}$.

Figure 4:
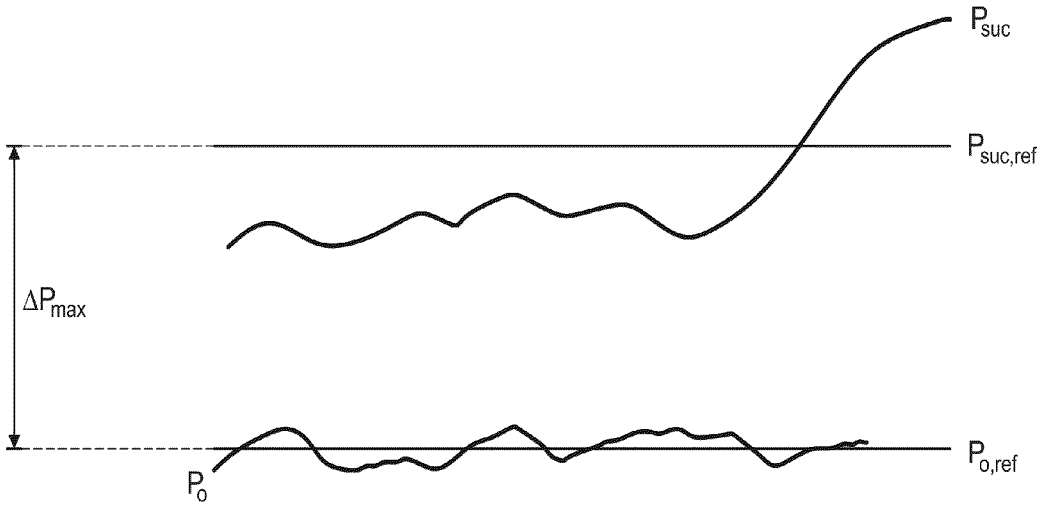
FIG. 4 is a graph illustrating pressure conditions in a vapour compression system being operated in accordance with a method according to an embodiment of the invention.

FIG. 4 is a graph illustrating pressure conditions in a vapour compression system being operated in accordance with a method according to an embodiment of the invention. The vapour compression system could, e.g., be one of the vapour compression system shown in FIGS. 1-3.

Reference pressure values, $P_{0,ref}$ and $P_{suc,ref}$, are shown. It can be seen that $P_{suc,ref}$ has been selected in such a manner that $P_{suc,ref}=P_{0,ref}+\Delta P_{max}$, where $\Delta P_{EX}$ is a maximum attainable pressure lift provided by an ejector forming part of the vapour compression system.

Actual pressure values, $P_0$ and $P_{suc}$, have been measured and plotted as a function of time. It can be seen that initially $P_{suc}$ is well below the corresponding reference pressure value, $P_{suc,ref}$, thereby indicating that $P_{suc}$ is within an acceptable range. The compressor unit of the vapour compression system is therefore controlled based on $P_0$, resulting in $P_0$ performing small variation around the corresponding reference pressure value, $P_{0,ref}$.

At a certain point in time, $P_{suc}$ starts increasing, eventually to a level above $P_{suc,ref}$. This introduces a risk that the pressure in the part of the refrigerant path which is connected to the inlet of the compressor unit may reach an unacceptable level. Therefore, when $\varepsilon_{suc}=P_{suc}-P_{suc,ref}$ reaches a level where it becomes larger than $\varepsilon_0=P_0-P_{0,ref}$, the compressor unit is instead controlled based on $P_{suc}$, in order to decrease $P_{suc}$ to a level corresponding to $P_{suc,ref}$, or lower.

Figure 5:
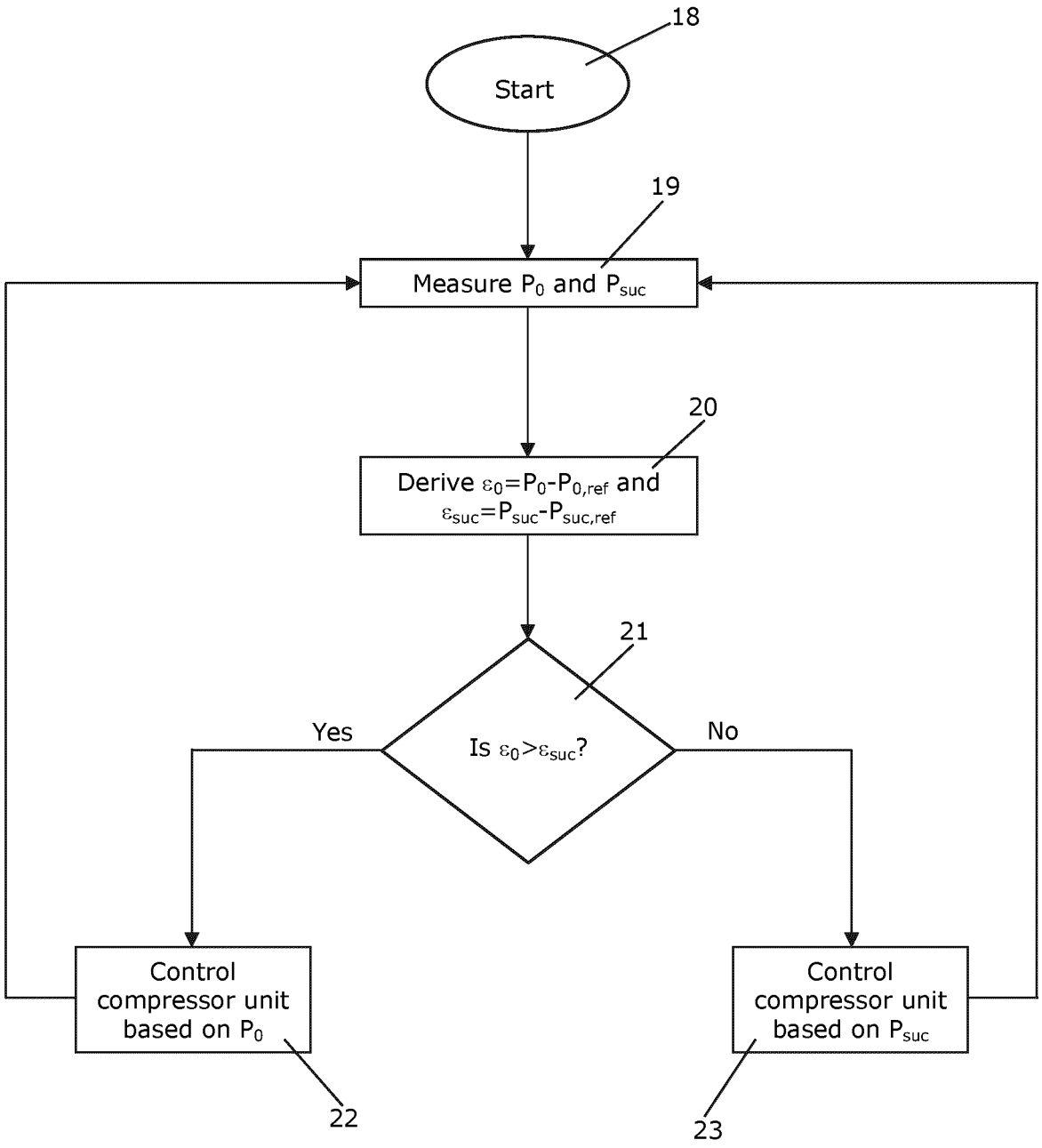
FIG. 5 is a flow chart illustrating a method according to an embodiment of the invention.

FIG. 5 is a flow chart illustrating a method according to an embodiment of the invention. The process is started at step 18. At step 19, a pressure, $P_0$, of refrigerant leaving the evaporator and a pressure, $P_{suc}$, of refrigerant entering the compressor unit are measured. It should be noted that $P_{suc}$, or another value being representative for $P_{suc}$, could be obtained in another manner than by direct measurement, as described in detail above.

At step 20, error values, $\varepsilon_0$ and $\varepsilon_{suc}$, are derived as $\varepsilon_0=P_0-P_{0,ref}$ and $\varepsilon_{suc}=P_{suc}-P_{suc,ref}$, where $P_{0,ref}$ and $P_{suc,ref}$ are reference pressure values corresponding to $P_0$ and $P_{suc}$, respectively.

At step 21 it is investigated whether $60>\varepsilon_{suc}$. If this is the case, the process is forwarded to step 22, where the compressor unit is controlled based on $P_0$. In the case that step 21 reveals that $\varepsilon_0$ is not larger than $\varepsilon_{suc}$, the process is instead forwarded to step 23, where the compressor unit is controlled based on $P_{suc}$. From step 22 as well as from step 23, the process is returned to step 19 for new measurements of $P_0$ and $P_{suc}$.

It should be noted that the error values, $\varepsilon_0$ and $\varepsilon_{suc}$, need not be expressly derived at step 20, as long as it is possible to perform the investigation of step 21.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for controlling a vapour compression system, the vapour compression system comprising a compressor unit comprising one or more compressors, a heat rejecting heat exchanger, an ejector, a receiver, at least one expansion device and at least one evaporator arranged in a refrigerant path, an outlet of the heat rejecting heat exchanger being connected to a primary inlet of the ejector, an outlet of the ejector being connected to an inlet of the receiver, and an outlet of the evaporator being connected to a secondary inlet of the ejector and to an inlet of the compressor unit, wherein the vapour compression system further comprises a non-return valve arranged in the refrigerant path between the outlet of the evaporator and the inlet of the compressor unit, in such a manner that a refrigerant flow from the outlet of the evaporator towards the inlet of the compressor unit is allowed, while a fluid flow from the inlet of the compressor unit towards the outlet of the evaporator is prevented, wherein a gaseous outlet of the receiver is connected to the inlet of the compressor unit via a bypass valve, the method comprising the steps of:

measuring a pressure, $P_0$, of refrigerant leaving the evaporator, obtaining a value being representative for a pressure, $P_{suc}$, of refrigerant entering the compressor unit, comparing the pressures, $P_0$ and $P_{suc}$, to respective reference pressure values, $P_{0,ref}$ and $P_{suc,ref}$, determining $\varepsilon_0=P_0-P_{0,ref}$ and determining $\varepsilon_{suc}=P_{suc}-P_{suc,ref}$, in the case that $\varepsilon_0>\varepsilon_{suc}$, controlling the compressor unit based on $P_0$, and in the case that $\varepsilon_{suc}>\varepsilon_0$, controlling the compressor unit based on $P_{suc}$.

2. The method according to claim 1, wherein $P_{suc,ref}$ is selected in such a manner that $P_{suc,ref}=P_{0,ref}+\Delta P_{max}$, where $\Delta P_{max}$ is a maximum attainable pressure lift provided by the ejector.

3. The method according to claim 2, further comprising the step of controlling a pressure prevailing inside the receiver by adjusting an opening degree of the bypass valve.

4. The method according to claim 2, wherein the step of obtaining a value being representative for the pressure, $P_{suc}$, comprises measuring $P_{suc}$.

5. The method according to claim 2, wherein the step of controlling the compressor unit based on $P_0$ comprises controlling the compressor unit in order to obtain that $P_0=P_{0,ref}$, and/or the step of controlling the compressor unit based on $P_{suc}$ comprises controlling the compressor unit in order to obtain that $P_{suc}=P_{suc,ref}$.

6. The method according to claim 1, wherein the vapour compression system comprises at least one medium temperature evaporator and at least one low temperature evaporator, and wherein the pressure, $P_0$, is measured at an outlet of the medium temperature evaporator.

7. The method according to claim 6, wherein the vapour compression system further comprises a low temperature compressor unit, and wherein an outlet of the low temperature evaporator is connected to an inlet of the low temperature compressor unit, and an outlet of the low temperature compressor unit is connected to the inlet of the compressor unit.

8. The method according to claim 7, further comprising the step of controlling a pressure prevailing inside the receiver by adjusting an opening degree of the bypass valve.

9. The method according to claim 7, wherein the step of obtaining a value being representative for the pressure, $P_{suc}$, comprises measuring $P_{suc}$.

10. The method according to claim 7, wherein the step of controlling the compressor unit based on $P_0$ comprises controlling the compressor unit in order to obtain that $P_0=P_{0,ref}$, and/or the step of controlling the compressor unit based on $P_{suc}$ comprises controlling the compressor unit in order to obtain that $P_{suc}=P_{suc,ref}$.

11. The method according to claim 6, further comprising the step of controlling a pressure prevailing inside the receiver by adjusting an opening degree of the bypass valve.

12. The method according to claim 6, wherein the step of obtaining a value being representative for the pressure, $P_{suc}$, comprises measuring $P_{suc}$.

13. The method according to claim 6, wherein the step of controlling the compressor unit based on $P_0$ comprises controlling the compressor unit in order to obtain that $P_0=P_{0,ref}$, and/or the step of controlling the compressor unit based on $P_{suc}$ comprises controlling the compressor unit in order to obtain that $P_{suc}=P_{suc,ref}$.

14. The method according to claim 6, wherein the step of controlling the compressor unit based on $P_0$ comprises controlling the compressor unit in order to obtain that $P_0=P_{0,ref}$, and/or the step of controlling the compressor unit based on $P_{suc}$ comprises controlling the compressor unit in order to obtain that $P_{suc}=P_{suc,ref}$.

15. The method according to claim 1, further comprising the step of controlling a pressure prevailing inside the receiver by adjusting an opening degree of the bypass valve.

16. The method according to claim 15, wherein the step of obtaining a value being representative for the pressure, $P_{suc}$, comprises measuring $P_{suc}$.

17. The method according to claim 1, wherein the step of obtaining a value being representative for the pressure, $P_{suc}$, comprises measuring $P_{suc}$.

18. The method according to claim 1, wherein the step of obtaining a value being representative for the pressure, $P_{suc}$, comprises measuring a pressure prevailing inside the receiver and deriving $P_{suc}$ from the pressure prevailing inside the receiver.

19. The method according to claim 1, wherein the step of obtaining a value being representative for the pressure, $P_{suc}$, comprises deriving $P_{suc}$ from $P_0$.

20. The method according to claim 1, wherein the step of controlling the compressor unit based on $P_0$ comprises controlling the compressor unit in order to obtain that $P_0=P_{0,ref}$, and/or the step of controlling the compressor unit based on $P_{suc}$ comprises controlling the compressor unit in order to obtain that $P_{suc}=P_{suc,ref}$.

* * * * *